US006848367B2

(12) United States Patent
Fouqueau et al.

(10) Patent No.: US 6,848,367 B2
(45) Date of Patent: Feb. 1, 2005

(54) PRIMING DEVICE FOR THE EXPLOSIVE CHARGE OF A SUB-MUNITION

(75) Inventors: Philip Fouqueau, Bourges (FR); Jean-Paul Dupuy, Bourges (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/415,531

(22) PCT Filed: Nov. 6, 2001

(86) PCT No.: PCT/FR01/03416

§ 371 (c)(1),
(2), (4) Date: Apr. 30, 2003

(87) PCT Pub. No.: WO02/39049

PCT Pub. Date: May 16, 2002

(65) Prior Publication Data

US 2003/0217664 A1 Nov. 27, 2003

(30) Foreign Application Priority Data

Nov. 7, 2000 (FR) ..... 00 14365

(51) Int. Cl.[7] ..... F42B 12/58
(52) U.S. Cl. ..... 102/489; 102/227; 102/230
(58) Field of Search ..... 102/489, 473, 102/227, 230, 226, 229, 245, 388, 240

(56) References Cited

U.S. PATENT DOCUMENTS 3,302,572 A * 2/1967 Lindberg et al. ..... 102/245
4,653,401 A * 3/1987 Gatti ..... 102/226
4,762,066 A * 8/1988 Rudenauer et al. ..... 102/226
4,998,476 A * 3/1991 Rudenauer et al. ..... 102/226
5,022,325 A * 6/1991 Skowasch et al. ..... 102/226
5,387,257 A * 2/1995 Tari et al. ..... 102/226

FOREIGN PATENT DOCUMENTS

| | | |
|---|---|---|
| EP | 0 411 243 A1 | 2/1991 |
| EP | 0 756 151 A1 | 1/1997 |
| FR | 2 214 104 | 8/1974 |
| FR | 2 650 662 A1 | 2/1991 |
| FR | 2 737 293 A1 | 1/1997 |
| GB | 2 348 942 A | 10/2000 |

* cited by examiner

*Primary Examiner*—Jack Keith
*Assistant Examiner*—L. Semunegus
(74) *Attorney, Agent, or Firm*—Oliff & Berridge, PLC

(57) ABSTRACT

The present invention relates to priming device for the explosive charge of a sub-munition scattered by a carrier, of the type incorporating a firing pin onto which a deployable drag ribbon has been attached, a primer able to be driven by a motor organ and a detonating primer to ignite the explosive charge. This device also comprises self-destruction means for the sub-munition operating after a predetermined delay, such means being activated by the extraction of a self-destruction lock. It is characterized in that the self-destruction lock is integral with the drag ribbon and is therefore extracted by the ribbon during its deployment.

12 Claims, 3 Drawing Sheets

PRIMING DEVICE FOR THE EXPLOSIVE CHARGE OF A SUB-MUNITION

BACKGROUND OF THE INVENTION

The technical scope of the present invention is that of priming devices for the explosive charge of a sub-munition onboard a carrier, for example a rocket. These sub-munitions are, classically, stacked on several columns inside the carrier, then scattered in great number over the target.

The priming devices for sub-munitions scattered by a carrier must satisfy safety conditions during the phases of storage and handling before their use.

After firing, in the event of the non-functioning of the main priming device of the charge, secondary self-destruction means are generally controlled to avoid polluting the field with live, and therefore hazardous, sub-munitions.

A simple and economical way to create self-destruction means is to implement a delay composition ignited by a firing pin.

Patent FR2650662 describes such means in which a self-destruction firing pin is integral with the primer slide. The disadvantage of these means lies in that if the primer slide is blocked, self-destruction is not activated. Patent FR2737293 also describes a priming device for an on-board sub-munition notably comprising a firing pin, primer, means to lock the primer and self-destruction means.

The self-destruction means comprise a pivoting cam armed by a spring and carrying a firing pin. This cam is held in the safety position by a lock formed by a finger integral with a primer drum.

Once again, the primer holds the self-destruction means in place. If for any reason the primer drum does not pivot, self-destruction is not triggered.

Moreover, the cam exerts constant force on the primer drum. This may result in sticking after long storage periods. This may in turn disturb the passage of the primer into its armed position.

SUMMARY OF THE INVENTION

The aim of the invention is to propose a self-destruction primer device that does not suffer from such drawbacks.

Thus, the device according to the invention incorporates means to lock the self-destruction device that are simple in structure, reliable, whose release is independent of that of the primer and which do not disturb the displacement of the primer.

The invention thus relates to a priming device for the explosive charge of a sub-munition scattered by a carrier, of the type incorporating a firing pin onto which a deployable drag ribbon has been attached, a primer able to be driven by a motor organ and a detonating primer to ignite the explosive charge, such device also comprising self-destruction means for the sub-munition operating after a predetermined delay, such means being activated by the extraction of a self-destruction lock, wherein the self-destruction lock is integral with the drag ribbon and is therefore extracted by the ribbon during its deployment.

According to a particular embodiment, the self-destruction means may comprise a self-destruction slide pushed by a spring and immobilized by the self-destruction lock.

Advantageously, the self-destruction means may comprise a delay cord whose input will be connected to a fire trigger relay ignited by a self-destruction firing pin carried by the self-destruction slide, the output of the delay cord being connected to a detonation relay acting on the detonating primer.

According to a particular embodiment, the priming device may comprise a body formed of two parts made integral with one another, the delay cord being pinched between these two parts of the body.

The primer may, in this case, be constituted by a drum comprising two trunnions allowing it to pivot with respect to the body, the trunnions of the drum being pinched between the two parts of the body.

The drive organ of the primer drum may be formed by a torsion spring mounted around one of the trunnions.

One of the drum's trunnions may have an axial bore allowing the primer to communicate with the detonation relay of the delay cord.

The self-destruction slide may incorporate a finger cooperating in the safety position with a flat on the primer drum such as to ensure the immobilization of the drum.

According to a variant embodiment, the self-destruction lock may incorporate a thinned median part on which the self-destruction slide presses and a lower part of a larger diameter that is arranged below the slide.

The firing pin may be held in place by blocking means from which it will be able to release itself by rotating, the blocking means for the firing pin being a nut mounted free to translate and linked in rotation in a housing in the body.

BRIEF DESCRIPTION OF THE DRAWINGS

Other characteristics, details and advantages of the invention will become more apparent from the following description given by way of illustration and with reference to the appended drawings, in which.

DESCRIPTION OF PREFERRED EMBODIMENTS

The priming device according to the invention is intended to be integrated into a fuse equipping the explosive charge of a sub-munition such as a grenade. Operation in the impact mode is obtained by the inertia of the firing pin.

Figure 1:
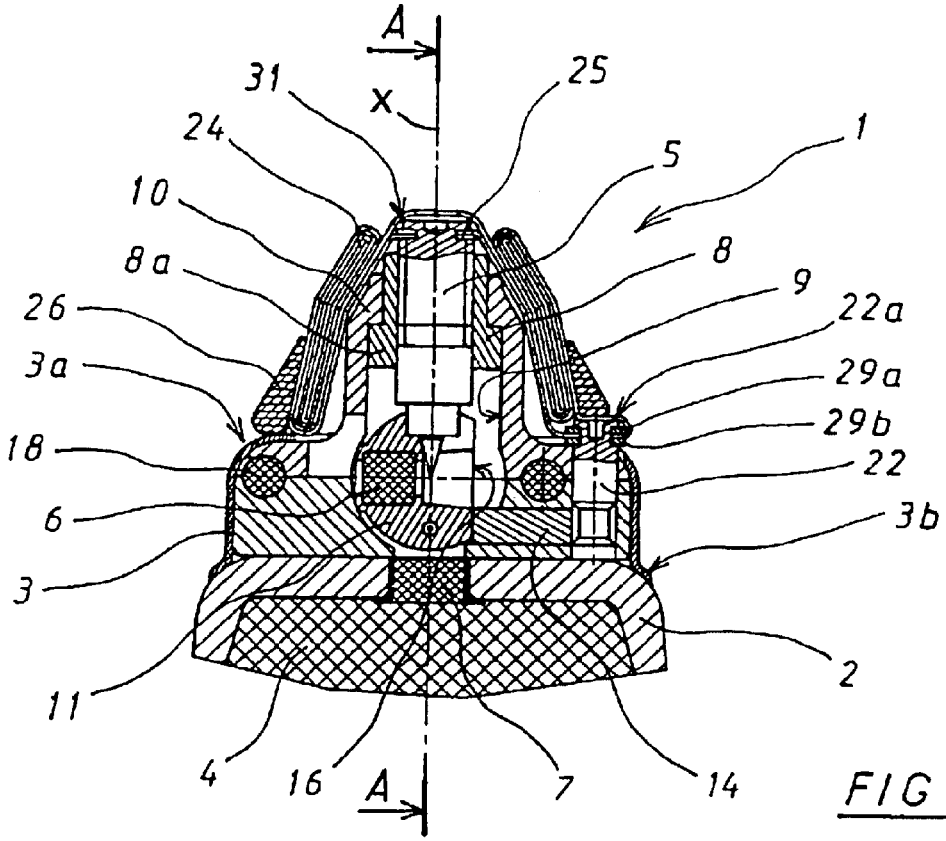
FIG. 1 is a longitudinal section of the priming device made along plane BB in FIG. 2, the device being shown in the safety position.
Figure 2:
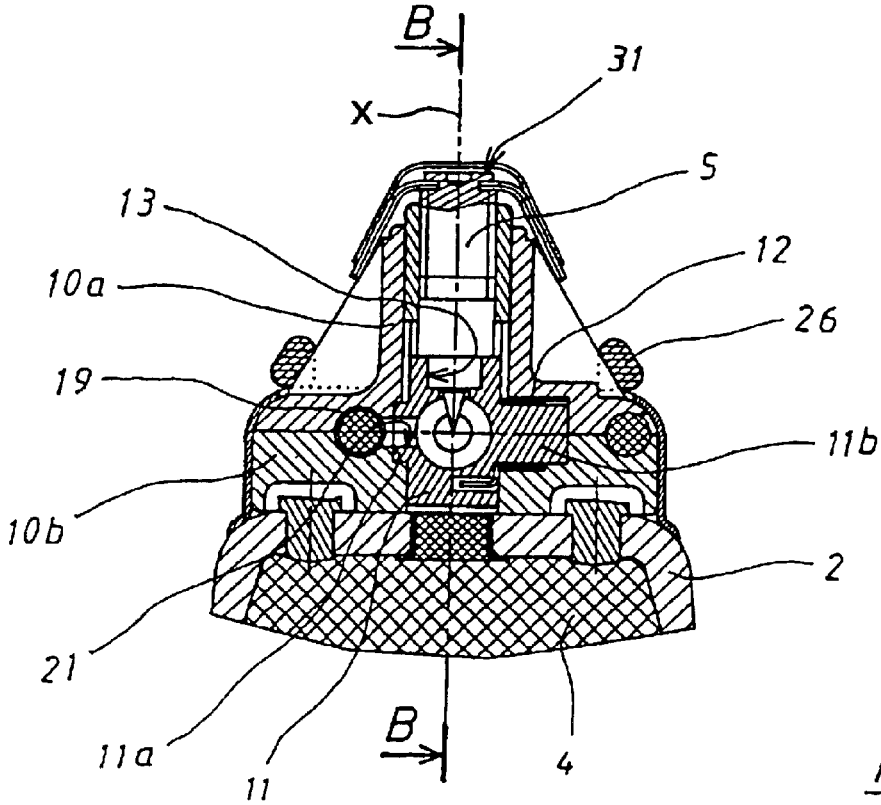
FIG. 2 is a longitudinal section of the priming device according to plane AA in FIG. 1, the device also being shown in the safety position.
Figure 3:
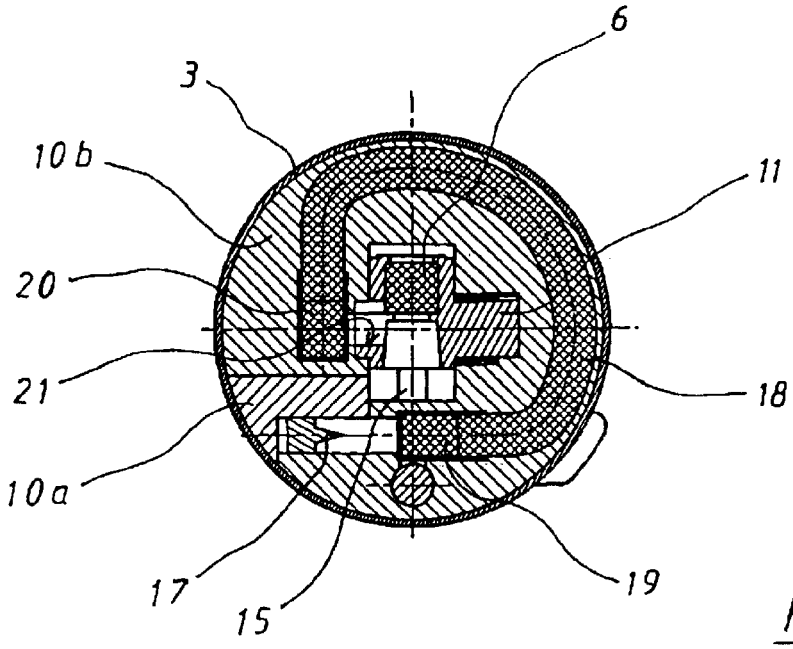
FIG. 3 is a cross section made level with the self-destruction firing pin, the device being here again in the safety position.

FIG. 1 shows a priming device 1 according to the invention that is attached onto the casing 2 of a sub-munition by means of a metal sheet cup 3. The cup incorporates an upper fold 3*a* that is applied to the device 1 and has a lower edge 3*b* welded to the casing 2 of the sub-munition.

The casing 2 of the sub-munition is only partially represented. It encloses an explosive load 4 onto which a concave-shaped (for example, conical) metallic liner (for example, copper) is applied in a known manner. Shaped charge or hollow charge munitions are well known to the expert and reference may be made, for example, to patent FR2650662 which describes such a sub-munition.

The priming device 1 according to the invention comprises a firing pin 5 arranged along an axis X and intended to ignite the charge 4 by means of a primer 6 and a detonation relay 7.

Classically, an extraction ribbon 24 is attached to the end of the firing pin 5 opposite its tip. Here, the ribbon is shown folded (as it is inside the projectile or carrier).

The ribbon 24 is attached to the firing pin by means of crimping 31 the end of the pin. The ribbon is pinched between a shoulder on the firing pin and a retention washer 25 onto which the crimping presses.

An elastic ring 26 made of a plastic material ensures the ribbon is held in its folded position. It is ejected when the sub-munitions are scattered so as to release the ribbon which is then able to deploy so as to stabilize the sub-munition and extract the firing pin.

The firing pin 5 is screwed in a nut 8 that is free to translate with respect to a body 10 of the device 1 whilst being linked in rotation in a housing 9 in the body 10. The nut thus has a substantially rectangular head 8*a* that slips into matching grooves in the body 10.

The body 10 of the device is formed of two parts: an upper part 10*a*, which receives the firing pin and its nut, and a lower part 10*b*, which presses on an upper face of the casing 2 of the sub-munition.

The two parts 10*a* and 10*b* of the body are made integral with one another by riveting (not shown).

A drum 11 carrying the primer 6 is placed between the two parts 10*a* and 10*b* of the body 10. It has two trunnions 11*a* and 11*b* that guide its pivoting with respect to the body 10. A torsion spring 12 is placed around the trunnion 11*b* of the drum and is intended to ensure the drum passes from its safety to its armed position.

The drum 11 is locked in the safety position shown in FIGS. 1 to 4 by the firing pin 5 one cylindrical end of which penetrates into a matching housing 13 in the drum 11.

Figure 7:
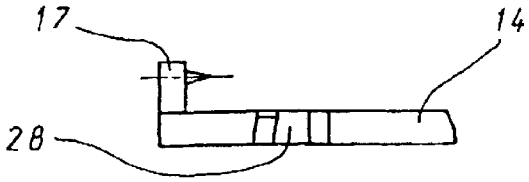
FIG. 7 shows a side view of the self-destruction slide alone.

The drum 11 is also locked in its safety position by a self-destruction slide 14. This slide 14 can be most clearly seen in FIGS. 4 and 7. It is globally parallelepipedic in shape and slides in a matching housing made in the lower part 10*b* of the body. The slide 14 carries a finger 15 that co-operates with a flat 16 on the drum 11 such as to prevent it from rotating.

The self-destruction slide 14 also carries a firing pin 17 (see FIGS. 3 and 7) intended to ignite a fire trigger relay 19 integral with a pyrotechnic delay cord 18.

The delay cord 18 is pinched between the upper 10*a* and lower 10*b* parts of the body 10.

Examples of pyrotechnic delay cords are given in patents FR2650662 and FR2706449.

At its output end the cord 19 has a detonating relay 20. This relay is able to ignite the primer 6 via a bore 21 made axially through a trunnion 11*a* of the drum 11.

It is therefore certain that the primer 6 will be destroyed by the self-destruction means whatever the angular position of the drum 11.

Figure 4:
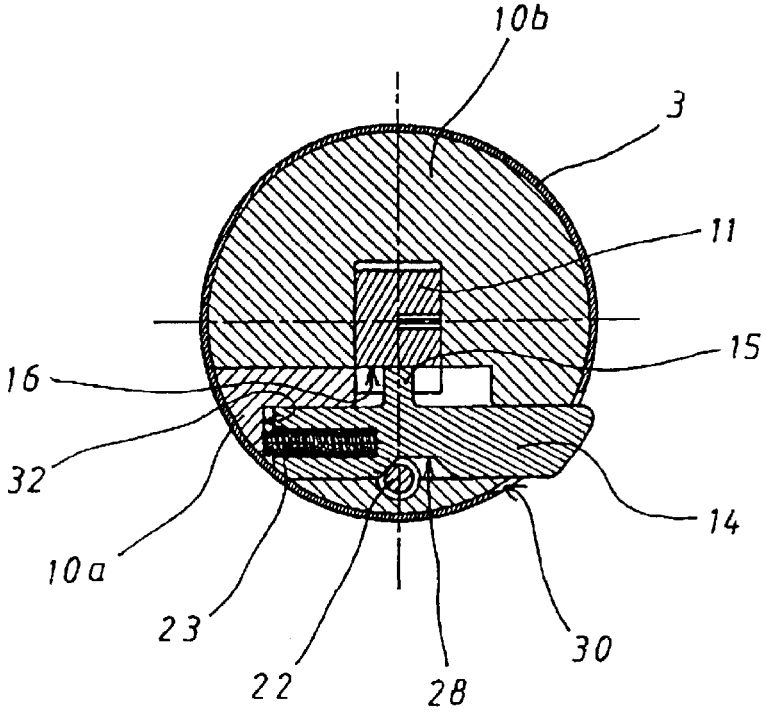
FIG. 4 is a cross section made level with the self-destruction slide, the device being in the safety position.

The self-destruction slide 14 is subjected to the action of a spring 23 that presses on an abutment surface 32 of the body 10*a* (see FIG. 4). The spring is in the compressed state when the device is in the safety position shown in FIGS. 1 to 4.

According to the invention, the self-destruction slide 14 is immobilized with respect to the body 10 in this safety position by means of a self-destruction lock 22. The lock 22 is substantially cylindrical. It is positioned, in a direction parallel to the axis X of the firing pin, in a cylindrical housing 27 arranged both in the upper part 10*a* and the lower part 10*b* of the body 10.

Thus, when the lock 22 is put into place it protrudes inside the housing of the slide 14 and is positioned in a notch 28 in the slide 14 (see FIG. 4).

In accordance with the invention, the self-destruction lock 22 is made integral with the extraction ribbon 24. The ribbon 24 is thus pinched between two washers 29*a*, 29*b*. Washer 29*b* presses on a shoulder of the lock and one end 22*a* of the self-destruction lock is crimped on washer 29*a* (see FIGS. 1 and 5).

The lock 22 also has a thinned median part 22*b* delimited by two bevels 22*c*/22*d*.

The slide 14 abuts against the thinned part 22*b* of the lock and the lower bevel 22*d* is then positioned below the slide 14. The effect of such an arrangement is to require a minimal extraction force to remove the self-destruction lock 22 from its housing 27. The presence of the bevel 22*d* requires a slight compression of the self-destruction spring 23 if the extraction is to be effective. The accidental unlocking of the self-destruction means is thereby avoided, notably during the assembly or integration phases of the device.

Such means may be completed or replaced by a complementary safety system, for example a pin (not shown) making the lock 22 and the body 10 integral during the assembly phases, said pin being retracted during the integration of the sub-munitions in a munition body.

The device operates as follows.

The sub-munitions are carried on board a carrier or cargo munition, such as a shell or rocket.

During the trajectory of the munition, the sub-munitions are ejected and commence their descent to the ground whilst being subject to the aerodynamic effects due to the velocity and spin.

The ribbon 24 is released and deploys, causing the self-destruction lock 22 to be extracted from its housing.

The extraction of the lock 22 releases the self-destruction slide 14 that is pushed by its spring 23. As it moves, the finger 15 of the slide disengages from the flat 16 of the primer drum 11, which is no longer prevented from rotating.

During the fall of the sub-munition, the aerodynamic forces exerted on the ribbon as well as the rotation of the sub-munition ensure that the firing pin 5 is also driven in rotation with respect to its nut 8.

Figure 5:
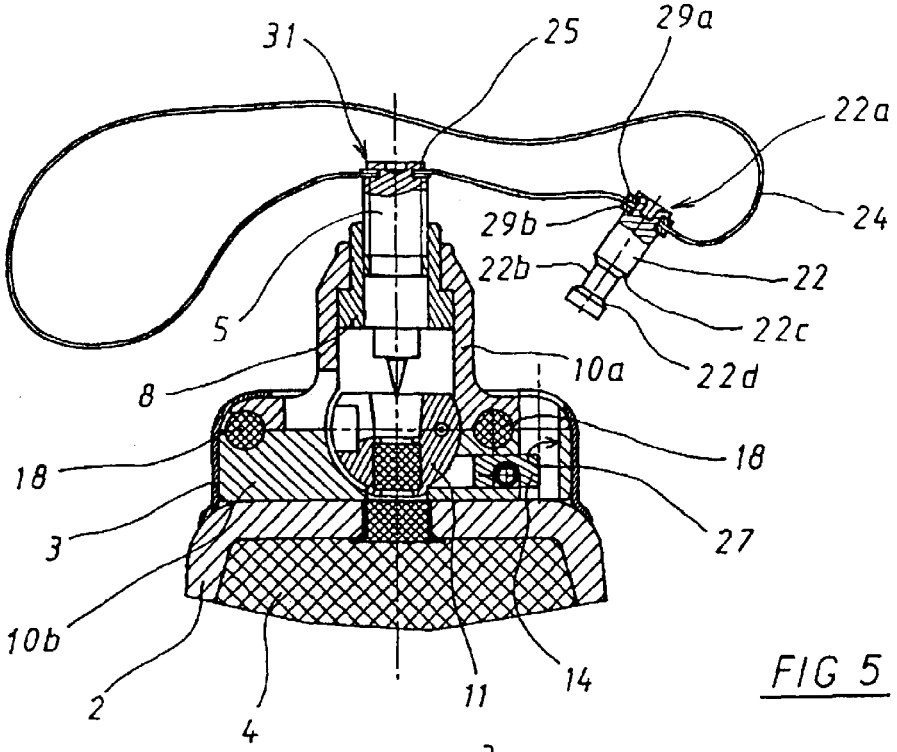
FIG. 5 is a longitudinal section of the device shown in the armed position.
Figure 6:
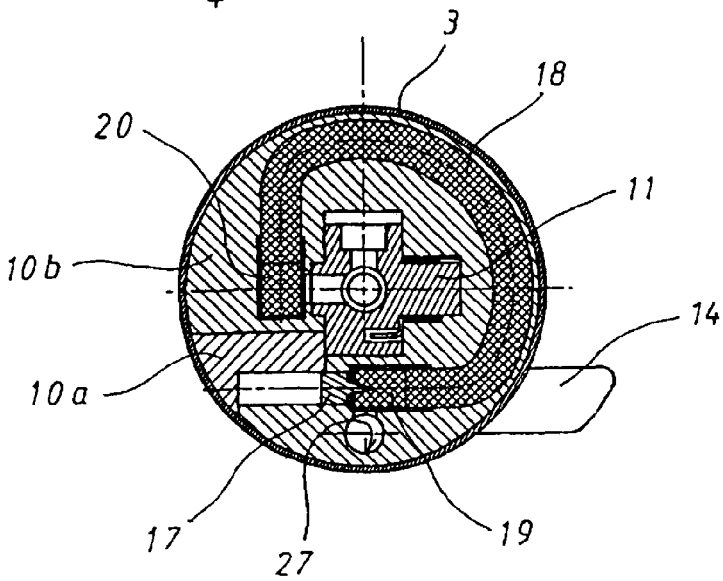
FIG. 6 is a cross section view of the device in the armed position, said section made level with the firing pin.

The firing pin 5 unscrews from the nut 8 until reaching its high position, as shown in FIG. 5.

When the firing pin 5 occupies this position, it no longer immobilizes the primer drum 11.

The two locks of the drum 11 (the finger 155 and the firing pin 5) are thus successively retracted.

Once released, the drum 11 is driven by its spring 12 and moves into the armed position shown in FIG. 5. In this position, the primer 6 is aligned with the firing pin 5. The drum is only effectively released after a few spins of the firing pin 5, thereby generating an arming delay preventing the sub-munitions from being ignited during their separation and stabilization phase.

The traction exerted on the firing pin 5 by the ribbon 24 keeps the nut/firing pin assembly in the high position.

Furthermore, we point out that the arming phase may only be carried out after the displacement of the slide 14, the end of which exits the device 1 through a slot 30 made in the cup 3.

When, classically, the sub-munitions are stacked on top of one another inside a munition, the casing of one sub-munition caps the priming device of the contiguous sub-munition thus preventing the self-destruction slide 14 from exiting the device.

The slide 14 is thus able to move only when the sub-munitions are separated from one another and the arming phase may thus only begin after such a separation.

The safety of the device is thereby improved by preventing inadvertent ignition resulting from the sub-munitions impacting against one another.

When the self-destruction slide 14 is displaced, the secondary firing pin 17 ignites the fire trigger relay 19 of the delay cord 18. The delay cord 18 is then ignited and the timing (30 to 50 seconds, for example) begins, regardless of the future functioning sequence of the pyrotechnic ignition chain of the charge 4. The percussion of the fire trigger relay 19 may naturally only take place when the slide 14 is displaced and therefore after the sub-munitions have been separated from one another.

The sub-munitions are stabilized during their flight phase by the ribbon 24 and fall substantially vertically.

Upon impact, the sub-munitions are subjected to a deceleration. Through inertia, the firing pin 5/nut 8 assembly is propelled towards the detonating primer 6 thereby ensuring its percussion. The explosive charge 4 is ignited and generates its intended terminal effects.

In the event of a non-ignition upon impact, for example because of an unfavorable angle of impact, or inadequate deceleration inertia (impact on soft ground), the self-destruction means neutralize the sub-munitions by destroying the primer 6 whatever the angular position of the primer drum 11.

The cord 18 ignites the detonation relay 20 at the end of the delay provided after the scattering of the sub-munition, such delay being defined by the length of the cord 18.

The relay 20 sympathetically ignites the primer 6 causing (if the drum 11 is in the armed position) the ignition and destruction of the warhead 4. If the drum is not in the armed position, the primer is nevertheless destroyed and the sub-munition neutralized.

We can see that the priming device according to the invention ensures the unfailing immobilization of the self-destruction slide 14 by a lock whose release is totally independent of the passage of the primer drum into its armed position. Indeed, this lock is retracted as soon as the stabilizing ribbon has been deployed.

The unfailing ignition of the delay cord of the self-destruction means is ensured as soon as the sub-munitions are separated and their ribbons have deployed. The self-destruction or neutralization of the sub-munitions that have not functioned on their target is thus reliably ensured.

Moreover, the self-destruction slide exerts neither stress nor strain on the primer drum. The finger 15 constitutes a simple obstacle preventing the primer drum from revolving but without applying any force to it.

The device according to the invention may naturally be adapted to any type of priming device incorporating a lock or rod having to be extracted to ignite self-destruction means, be these means electronic or pyrotechnic.

Attaching the extractable lock directly onto the stabilizing ribbon takes advantage of the ribbon's deployment to ensure the lock is retracted. The invention thereby allows the design of a priming device to be considerably simplified.

By way of a variant, the primer may also be made in the form of a slide rather than a revolving drum.

What is claimed is:

1. A priming device, for the explosive charge of a sub-munition scattered by a carrier, incorporating a firing pin onto which a deployable drag ribbon is attached, a primer and a detonating primer to ignite said explosive charge, such device also comprising self-destruction means for said sub-munition operating after a predetermined delay, such means being activated by the extraction of a self-destruction lock, wherein said self-destruction lock is integral with said drag ribbon and is therefore extracted by the ribbon during deployment of the ribbon.

2. A priming device according to claim 1, wherein said self-destruction means comprise a self-destruction slide pushed by a spring and immobilized by said self-destruction lock.

3. A priming device according to claim 2, wherein said self-destruction means comprise a delay cord whose input will be connected to a fire trigger relay ignited by a self-destruction firing pin carried by said self-destruction slide, the output of said delay cord being connected to a detonation relay acting on said detonating primer.

4. A priming device according to claim 3, wherein the priming device comprises a body formed of two parts made integral with one another, said delay cord being pinched between said two parts of said body.

5. A priming device according to claim 4, wherein said primer is mounted in a drum having two trunnions allowing the drum to pivot with respect to said body, said trunnions of said drum being pinched between said two parts of said body.

6. A priming device according to claim 5, further comprising a drive organ for the primer drum, wherein said drive organ formed by a torsion spring mounted around one of said trunnions.

7. A priming device according to claim 5, wherein one of said trunnions has an axial bore allowing said primer to communicate with said detonation relay of said delay cord.

8. A priming device according to claim 6, wherein one of said trunnions has an axial bore allowing said primer to communicate with said detonation relay of said delay cord.

9. A priming device according to claim 2, wherein said primer is mounted in a drum having two trunnions allowing the drum to pivot with respect to said body, and said self-destruction slide incorporates a finger co-operating in the safety position with a flat on said primer drum such as to ensure the immobilization of said drum.

10. A priming device according to claim 5, wherein said self-destruction slide incorporates a finger co-operating in the safety position with a flat on said drum such as to ensure the immobilization of said drum.

11. A priming device according to claim 2, wherein said self-destruction lock incorporates a thinned median part on which said self-destruction slide presses and a lower part of a larger diameter that is arranged below said slide.

12. A priming device according to claim 4, wherein said firing pin is held in place by blocking means from which it will be able to release itself by rotating, said blocking means for said firing pin being a nut mounted free to translate and linked in rotation in a housing in said body.

* * * * *